United States Patent [19]

Schinke

[11] 4,356,931

[45] Nov. 2, 1982

[54] LOCKING SYSTEM FOR A SYNTHETIC RESIN PACKING CONTAINER

[75] Inventor: Friedel Schinke, Löhne, Fed. Rep. of Germany

[73] Assignee: Sulo Eisenwerk Streuber & Lohmann GmbH & Co. KG, Herford, Fed. Rep. of Germany

[21] Appl. No.: 275,391

[22] Filed: Jun. 19, 1981

[30] Foreign Application Priority Data

Jun. 26, 1980 [DE] Fed. Rep. of Germany ..... 3024033

[51] Int. Cl.[3] ..... B65D 45/28

[52] U.S. Cl. ..... 220/323; 206/3

[58] Field of Search ..... 220/323; 206/583, 3

[56] References Cited

U.S. PATENT DOCUMENTS 2,793,787 5/1957 Lescure ..... 220/323

3,087,644 4/1963 Hill et al. ..... 220/323

4,159,764 7/1979 Schinke ..... 206/3

*Primary Examiner*—George T. Hall

*Attorney, Agent, or Firm*—Burgess, Ryan and Wayne

[57] ABSTRACT

A lid and locking system therefor at one end of an ammunition container with an outer shell is made up of a ring fixed on one end of the shell, a lid seated within the ring, a lock spider with the end of its legs taken up in openings in the ring, and a screw, supported by the spider, for forcing the lid against the ring. The lid has a castellated cover on its outer side. The segments of the cover, answering to its castellated form, come to an end in a plane at the end of the locking ring and are somewhat smaller in diameter than the diameter of a circle running through inner ends of ribs on and within the locking ring.

9 Claims, 2 Drawing Figures

LOCKING SYSTEM FOR A SYNTHETIC RESIN PACKING CONTAINER

CROSS-REFERENCE APPLICATION

The present invention is directed to a locking system for a synthetic resin packing container.

BACKGROUND OF THE INVENTION

The present invention is with respect to shock-proof packaging containers or shells for the separate packing of articles such as rounds of ammunition. More specially, the invention is addressed to a locking system for the lid of such a shell.

One design for a synthetic resin shock-proof container having a lid has been put forward in U.S. Pat. No. 4,159,764. The container, designed for separately packing goods, that is to say one article in each such container, is made up of an inner container shell and an outer container shell touching each other at certain points so that generally the shells are spaced from each other and the spaces therebetween give a shock-proofing effect so that when the container is dropped or has something dropped on it the shell walls will only be elastically bent.

Putting it somewhat differently, it may be said that this earlier container design was for safeguarding and shock-proofing the article within it against outside forces as far as possible. At the same time, handling of such containers was to be made simpler and the working life of the containers increased.

Such a container may be looked upon as one safeguarding fully and as completely as possible goods needing a shock-proof packaging system. A further keypoint of the earlier design was that the structure stored in the container might be simply got at by undoing a lid, even if such containers were stacked. In fact, if so stacked, there is no need for such containers to be opened only in a given order.

GENERAL OUTLINE OF THE INVENTION

One purpose of the present invention is that of designing a locking system, more specially for a synthetic resin container as in U.S. Pat. No. 4,159,764, which may be simply opened, makes certain that the inner space of the container is fully and safely shut, and is shock-proof to a very high extent.

For effecting this purpose and further purposes in the present invention a lock ring is permanently fixed to the opening end of an outer shell, the ring having supporting and guiding ribs next to lock openings of the wall and the lid furthermore has a castellated guard cover with spaced segment parts ending in a plane in line with said lock ring, the guard cover having an outer diameter somewhat smaller than the inner diameter of a circle running through inner ends of the support and guide ribs. Furthermore, there is a locking spider, having a screw for doing it up tight and locking on the lid.

From this it may be seen that, put somewhat differently, the general teaching of the present invention is that of bracing, clamping, tightening or squeezing on the lock spider in the lock openings in the wall of the lock ring.

However, in the prior art suggestions have been made in connection with sheet metal packaging containers to have a locking spider which is braced in the openings in the casing of the container shell. Such a sort of locking system, that is to say more specially without the locking ring, is responsible for permanent bending of the container if it is dropped on an edge of the outer shell. It is then no longer possible for the lid to be undone. If such a locking system is used with a synthetic resin container, the forces produced on dropping will be responsible for destruction of, and damage to the container so that the lid may come off.

It will be seen that the locking system of the present invention is specially geared to the properties and design of synthetic resin systems, the lid being very safely fixed in position so as to be simply undone and screwed up tight.

Further useful developments of the invention, covering furthermore a process for producing the locking system of the invention will be seen in the dependent claims.

DETAILED ACCOUNT OF WORKING EXAMPLE OF THE INVENTION

The account of the working example is based on the figures, in which.

Figure 1:
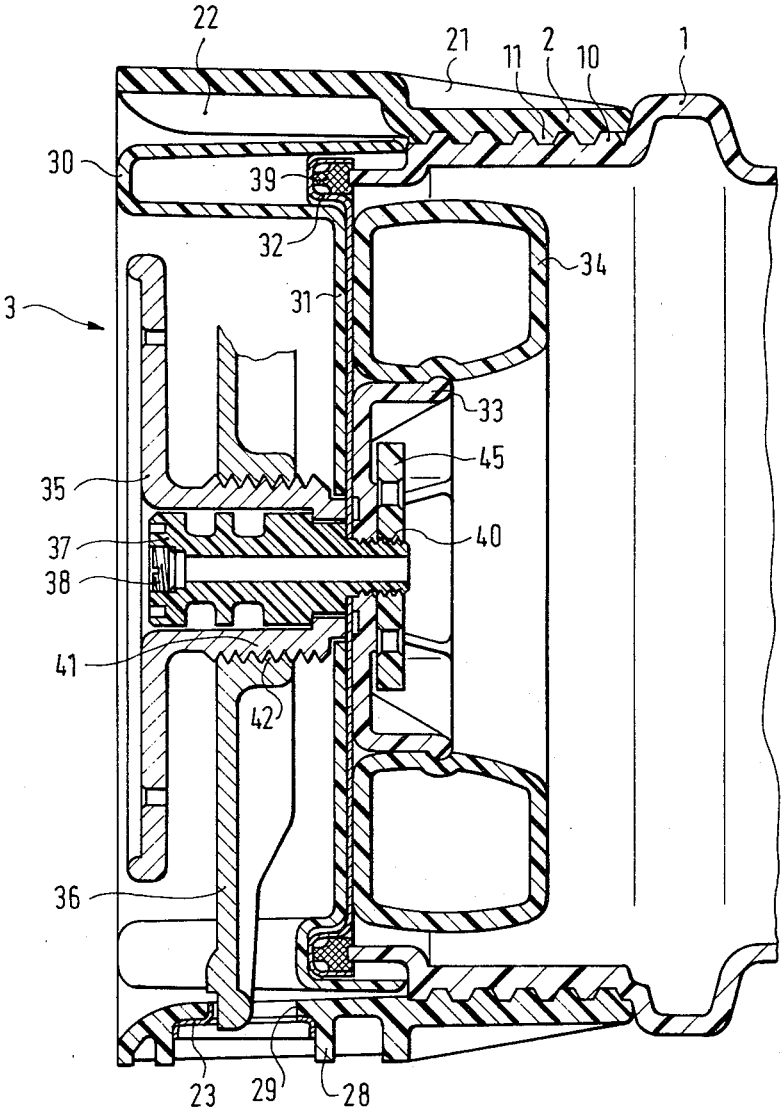
FIG. 1 is a cross-section of the locking system.

In FIG. 1 the outer shell of synthetic resin of a packing container has a male thread 10 molded on it at its end with the locking system. The packing container may be on the the same lines as detailed in U.S. Pat. No. 4,159,764. A separate lock ring 2, made of injection molded synthetic resin, has at its right hand end part (which may well be the lower part when the container is in use) a female thread 11 screwed onto the male thread 10 of outer shell 1. Lock ring 2 is put on the shell hot and is then fixed on it by shrinking.

This connection between the outer shell 1 and the lock ring 2 may not be undone or unscrewed because lock ring 2 has teeth (not to be seen in the figure) biting into male thread 10.

Figure 2:
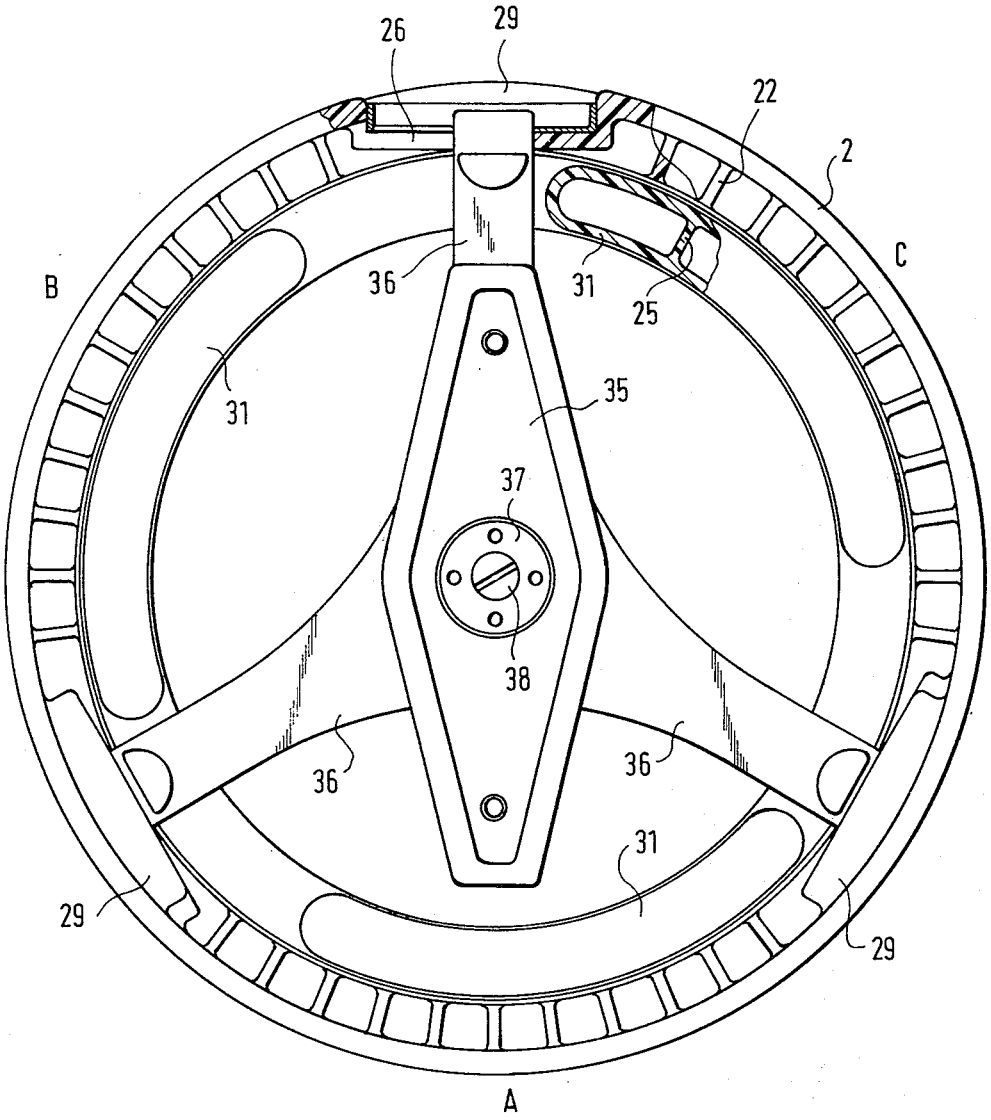
FIG. 2 is an end-on view and part section of the locking system to be seen in FIG. 1.

Lock ring 2 (see FIG. 2) has keeper openings 29 next to which (at A, B and C) there are support and guide walls 22 inwardly running. The lock keeper openings 29 have metal liners 23 having lock keeper faces and riveted to lock ring 2, or fixed thereto in some other way. The metal liners 23 may furthermore be placed between walls 28 in addition (as may be seen in the lowermost part of FIG. 1) running in the circumferential direction. The outer part of lock ring 2 has, furthermore, support walls or wings 21 running in the length-direction of shell 1. At the lock keeper openings 29, the wall of lock ring 2 is made thicker for forming a lock keeping structure and support for the lock spider. Side, or putting it more exactly, circumferential openings 26 (see FIG. 2) make it possible for the legs of the spider 36 to be turned and slipped into their locking positions with a sort of bayonet locking function.

A lid 3 is made up of a guard cover 31, a sheet metal cover 32 and a gasket 39 placed in its outer hollow lip or fold, a shock absorber support 33 having a hole for taking up a fixing screw 37 or guide bolt having a threaded bolt 40 at one end for taking up a washer 45. The support 33 supports a tire-like shock absorber 34 of synthetic resin. The shock absorber 34 is spring-locked on on support 33. A fixing screw 35, freely running on screw 37, has a handle and a hollow male-threaded stem 41. Furthermore the lid 3 has a spider 36, threadedly running on stem 41, of aluminum with a female thread 42. Fixing screw 37 is made of synthetic resin with a screw 38 therein for letting off air from the container.

The guard cover 31 of container lid 3 has a castellated form, that is to say it has outwardly (leftwardly) running segment parts 30 coming to an end in the plane of the end of lock ring 2 at the left hand of the structure. These leftwardly running segment parts of the castellated structure are double-walled and between their walls there are cross-walls 25 (see FIG. 2) for making the segment parts stronger. The outer diameter of the segment parts of guard cover 31 is only a little smaller than the inner diameter of a circle running through the inner ends of the support and guide walls 22 with rounded ends 12 on the lock ring 2. When the lid 3 is shut, there is, for this reason, between the support and guide walls 22 and the segment parts of the guard cover 31 only a small amount of play, as will be seen from FIG. 1.

This design of the lid 3 firstly makes certain that it is slipped centrally into the opening in the outer shell 1 and of the lock ring 2. Furthermore any outer forces, for example because the container is dropped, are taken up by the guard cover 31 and, for this reason, there is no damage to the outer shell 1. If on the other hand the left hand end of outer shell 1 is bent by outside forces, the guard cover 31 will be bent in the same way so that it may still be undone later without any trouble.

If an attempt is made at putting on the lid 3 when turned into the wrong position, the lock spider 36 will be stopped from being slipped into openings 29 by the support and guide walls 22, the walls 22 or ribs having the effect of guiding the lid 3 into the right position for doing up the locking system, that is to say into the part coming before the metal liners 23 which are supported by the special form of the cross-section of the lock ring (see lower part of FIG. 1). Lock spider 36 is then turned through a small distance out of this position into the locked position and done up tight by way of the locking screw 35, such screw 35 together with its handle and the female thread 42 on the threaded stem 41 forming the lock fixing system for doing the cover up tight. Within screw 35 there is the middle fixing screw 37 running through the guard cover 31, fixing on its inner end (within the container) the support 33 for the shock absorber 34. A screw-threaded washer 45 is used for locking the screw connection between the shock absorber support 33 and the middle fixing screw 37. If desired, these parts may be locked in position furthermore by melting the synthetic resin somewhat.

By simple turning of the handle, the lock spider 36 is moved into its locked position to the left or right and so braced or unbraced as the case may be.

I claim:

1. In a lid locking system for a synthetic resin shock-proof shell for packing one single article, the shell having a lid which is able to be opened for taking the article from the shell, the invention residing in that said locking system has (a) a lock ring fixed permanently to said support shell at an opening thereof, said lock ring having lock keeper openings with lock keeper faces and, next thereto, support and guide ribs, (b) a castellated guard cover with segment parts in line with the lock ring and having an outer diameter, somewhat smaller than the diameter of a circle running through inner ends of the support and guide ribs and (c) a lock spider having a screw for screwing it up tight, such spider having legs with outer ends designed to be taken up within said lock keeper openings and being forced against said lock keeper faces.

2. The locking system as claimed in claim 1, wherein said lock ring is fixed on said shell by a male thread molded on said shell, said male thread being taken up in a female thread in said lock ring.

3. The locking system as claimed in claim 2, wherein said lock ring has teeth biting into said male thread for stopping unscrewing of said lock ring.

4. The locking system as claimed in claim 1, wherein said lock ring has metal liners making up said keeper faces, said liners being riveted to said lock ring.

5. The locking system as claimed in claim 1, wherein said lock ring has an outer face with support walls thereon.

6. The locking system as claimed in claim 1, wherein at said lock openings said lock ring has a wall of increased thickness for said lock spider to be rested against and to take up the force of the spider acting thereon, said lock ring furthermore having circumferential openings through which said spider legs may be slipped into position by being turned.

7. The locking system as claimed in claim 1, wherein said segment parts of said guard cover are double-walled, such walls being supportingly joined together by walls running therebetween.

8. The locking system as claimed in claim 1, claim 2, or claim 3, wherein said screw has a middle guide bolt of synthetic resin having a screw therein for letting off air from said shell.

9. A process for making a door locking system on a synthetic resin container or packaging shell in a lid locking system for a synthetic resin shock-proof support shell of packing one single article, the support shell having a lid which is able to be opened for taking the article from the shell, wherein said locking system has a lock ring fixed permanently to said support shell at an opening thereof, said lock ring having locking openings with lock keeper faces and next thereto support and guide ribs, a guard cover with segment parts in line with the lock ring and having an outer diameter somewhat smaller than an inner diameter as fixed by the support and guide ribs, and a lock spider having a screw for screwing it up tight and wherein said lock ring is produced by injection molding and is fixed on said shell by shrinking.

* * * * *